US005203615A

United States Patent [19]

Zanetis et al.

[11] Patent Number: 5,203,615

[45] Date of Patent: Apr. 20, 1993

[54] FULL SIDE SHIFT SYSTEM FOR DETACHABLE ROTARY APPARATUS

[75] Inventors: C. Christopher Zanetis; William J. Bethards, both of Brownsburg, Ind.

[73] Assignee: Alitec Corporation, Brownsburg, Ind.

[21] Appl. No.: 815,804

[22] Filed: Dec. 30, 1991

[51] Int. Cl.[5] ..... E01C 23/09

[52] U.S. Cl. ..... 299/39; 299/73; 404/90

[58] Field of Search ..... 299/39, 73, 75; 404/90; 51/176; 37/2 R

[56] References Cited

U.S. PATENT DOCUMENTS

| | | | |
|---|---|---|---|
| 1,916,247 | 7/1933 | Barber . | |
| 3,767,262 | 10/1973 | Pentith | 299/39 X |
| 4,154,481 | 5/1979 | Heckenhauer et al. | 299/39 |
| 4,262,966 | 4/1981 | Bouplon | 299/39 |
| 4,762,371 | 8/1988 | Lupton | 299/39 |
| 4,808,026 | 2/1989 | Clarke, Jr. et al. | 404/90 |
| 4,878,713 | 11/1989 | Zanetis | 299/39 |
| 4,884,848 | 12/1989 | Wrulich et al. | 299/73 |

FOREIGN PATENT DOCUMENTS

| | | | |
|---|---|---|---|
| 3738438 | 5/1989 | Fed. Rep. of Germany | 299/73 |
| 2155525 | 9/1985 | United Kingdom | 299/39 |

*Primary Examiner*—David J. Bagnell

*Attorney, Agent, or Firm*—Baker & Daniels

[57] ABSTRACT

A rotary apparatus which can be detachably mountable to a self-propelled vehicle, such as a skid-steer front end loader. The apparatus includes opposing first and second frame members and an axially rotatable work implement having front and rear peripheries and left and right peripheries. The rotary apparatus provides a mechanism for supporting the work implement from the first and second frame members such that the front, rear, left and right peripheries may extend beyond the fronts of the frame members. A mechanism for shifting the position of the work implement in a direction parallel to a line between the first and second frame members is provided such that either one of the peripheries of the work implement may extend beyond the side edge of the first frame member. The capability to shift the work implement beyond the sides of the frame members allows the apparatus to be used to horizontally plane adjacent a vertical wall or obstruction, such as a curb.

16 Claims, 4 Drawing Sheets

FULL SIDE SHIFT SYSTEM FOR DETACHABLE ROTARY APPARATUS

FIELD OF THE INVENTION

This invention relates to a detachable rotary apparatus, such as a cold planer or a rock wheel, for vehicles such as a skid-steer loader, and, in particular, to an apparatus that is laterally shiftable.

BACKGROUND OF THE INVENTION

Several detachable rotary devices, such as cold pavement planers and rock wheels, are available for attachment to vehicles such as front end loaders, including the Model CP18 Cold Planer available from Alitec Corporation of Brownsburg, Indiana, the AP400 Cold Planer available from DigTec of Columbia, S.C., and the H18 Rock Wheel available from HydraWheel of Austin, Tex. The detachability of these devices from a vehicle has made them very cost effective since many other types of attachments may be mounted on the same vehicle. However, it is often difficult to use a cold planer or rock wheel near a vertical wall or obstruction, such as a curb.

The pavement planing machine disclosed in U.S. Pat. No. 4,878,713 may be attached to a skid-steer front end loader and may be both tilted and laterally shifted. However, the degree to which the housing of the rotary tool, the planer, can be shifted is limited. The planer cannot extend beyond the edges of the vertical supports of the frame of the apparatus. Therefore, it is difficult to use this planing machine to horizontally plane an area where a road surface meets a vertical wall or curb. The planing machine, through its tilting mechanism, may be able to plane near a curb if the vehicle straddles the curb or is positioned on the higher surface. However, it is desireable to keep the vehicle on a level surface, and, in many instances, it is impossible to straddle the curb. Other laterally shiftable planers and digging booms are disclosed in representative U.S. Pat. Nos. 4,262,966, 4,762,371 and 1,916,247. However, the rotary tools of these devices also cannot be laterally shifted beyond the interior edges of the frame. Therefore, it is desireable to provide a detachable rotary apparatus in which the tool is able to extend beyond the frame of the apparatus for these types of operations.

To laterally shift a rotary apparatus, various methods well known in the art may be used to provide power for the shifting. For example, both the tilting and shifting mechanisms in U.S. Pat. No. 4,878,713 are driven by a single hydraulic cylinder; the shifting mechanism disclosed in U.S. Pat. No. 4,262,966 is driven by a separate motor requiring power from a second source not already available from the front end loader; the planar disclosed in U.S. Pat. No. 4,762,371 uses an electric motor or power take-off from the tractor to which it is attached; and the rack and pinion system of the laterally shiftable digging boom disclosed in U.S. Pat. No. 1,916,247 is manually actuated through the use of a hand crank.

Stump grinders often provide a means for shifting a narrow drum beyond the sides of its frame. However, these devices move in a arcuate path rather than a linear lateral path as is preferred for pavement planing. Also, stump grinders generally have a narrow cutting device which is unsuitable for pavement planing.

OBJECTS OF THE INVENTION

It is one object of the present invention to provide a rotary apparatus, such as a planer or a rock wheel, in which the rotary tool is able to extend beyond the side of the frame of the apparatus.

It is another object of the present invention to provide a rotary apparatus which may be attached to a self-propelled vehicle, such as a front end loader.

It is still another object of the present invention to provide a detachable full width side shifting rotary apparatus which is driven by a hydraulic system.

It is still another object of the present invention to provide a detachable rotary apparatus in which the vehicle weight may be transferred to the rotary apparatus to improve the work of the rotary apparatus.

SUMMARY OF THE INVENTION

The invention comprises rotary apparatus which can be detachably mountable to a self-propelled vehicle, such as a skid-steer front end loader, and includes opposing first and second side frame members and an axially rotatable work implement having front and rear peripheries and left and right peripheries. The rotary apparatus provides a means supporting the work implement from the first and second frame members such that the front, rear, left and right peripheries may extend beyond the fronts of the frame members. A means for shifting the position of the work implement in a direction parallel to a line between the first and second frame members is provided such that either one of the peripheries of the work implement may extend beyond the side edge of the first frame member. The capability to shift the work implement beyond the sides of the frame members allows the apparatus to be used to horizontally plane adjacent a vertical wall or obstruction, such as a curb.

DETAILED DESCRIPTION

Figure 1:
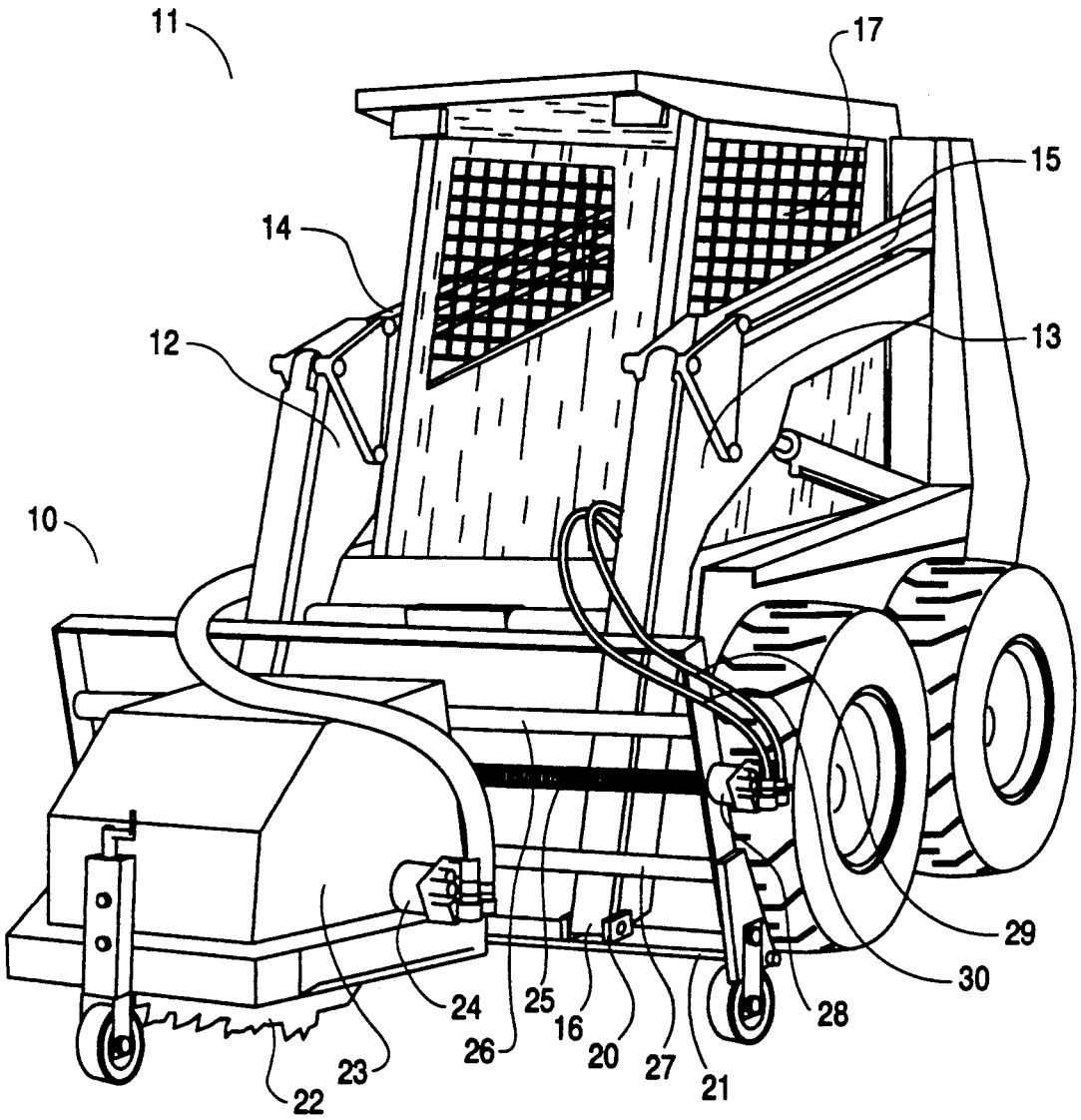
FIG. 1 shows a perspective view of the rotary attachment apparatus of the present invention as it is mounted on a front end loader.

Referring now to FIG. 1, there is shown a perspective view of the attachment apparatus of the present invention as it is mounted on a front end loader. Cold planer 10 is mounted to self-propelled vehicle 11, such as the skid-steer front end loaders models 1840 or 1845C made by JI Case of Racine, Wis. As is conventional, loader 11 includes a hydraulic pressure source. Lift arms 12,13 each extend outwardly adjacent opposite sides 14,15, respectively, of loader 11 and are able to swing up and down in unison. Each lift arm 12,13 provides an attachment means 16 which provides for the removable mounting of planer 10 to arms 12,13. Loader 11 also includes cab 17 from which an operator controls loader 11 and planer 10.

Cold planer 10 has means 20 (see FIG. 2) for attaching planer 10 to loader 11 by being mounted to lift arms 12,13. Such attachment means are well known in the art, and are described more fully in, for example, U.S. Pat. No. 4,878,713 which is incorporated herein by reference. In addition, planer 10 includes frame 21 and a ground engagable axially rotatable work implement 22. Work implement 22 is located in housing 23, is laterally shiftable with respect to frame 21, and may be hydraulically powered by hydraulic motor 24.

It will be appreciated by those of skill in the art that the rotary device may comprise a planer, rock wheel, or other work implement.

Figure 2:
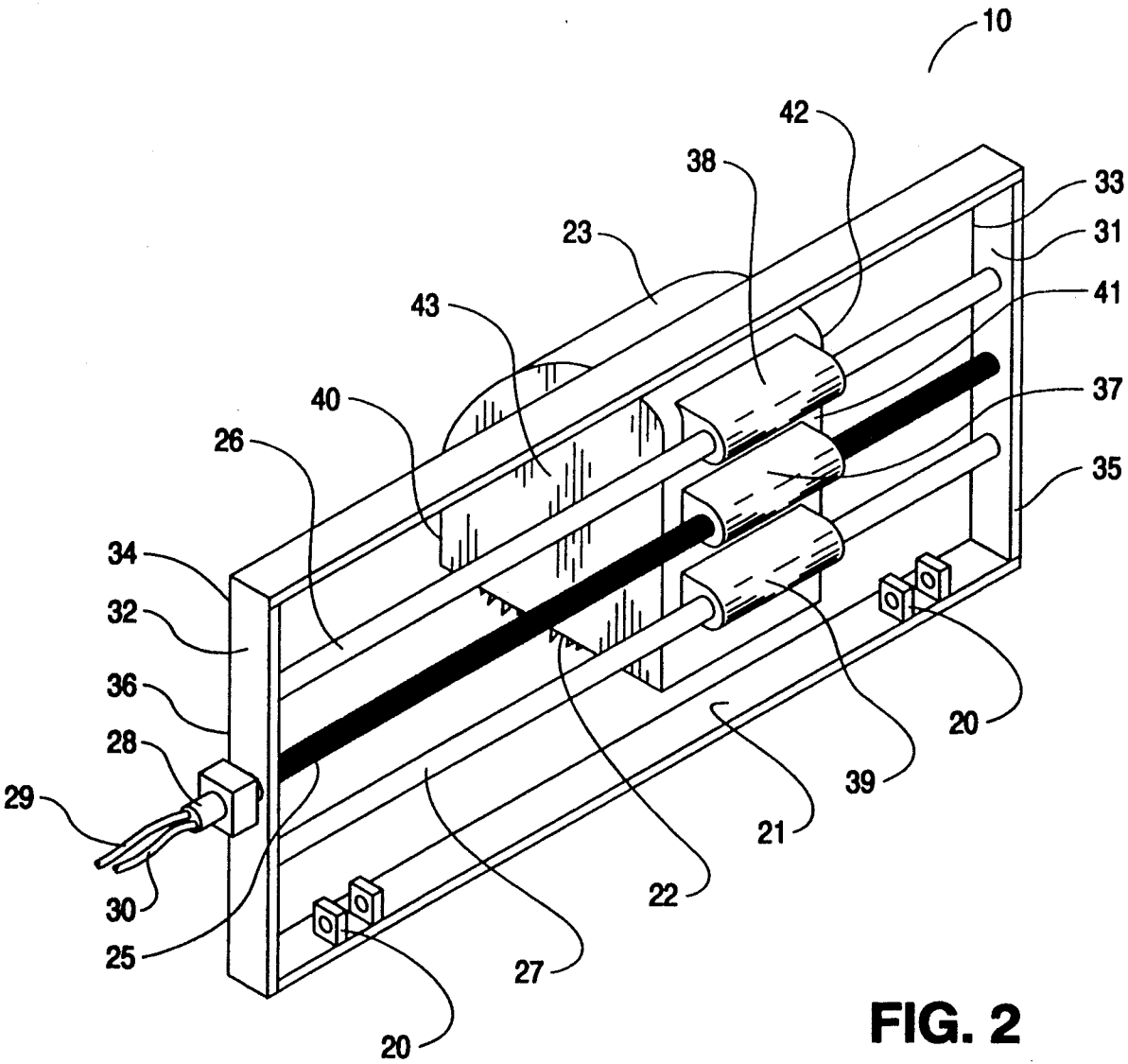
FIG. 2 shows a rear perspective view of the rotary attachment apparatus of the present invention.

FIG. 2 shows a rear perspective view of the attachment apparatus of the present invention. Frame 21 provides means 20 for attachment to lift arms 12,13 of self-propelled vehicle 11 and includes first frame member 31 and second frame member 32, each having front edges 33 and 34 and side edges 35 and 36, respectively. Rotary work implement 22 within housing 23 is supported by first and second support rods 26 and 27 and by threaded shaft 25, all of which are disposed between the first frame member 31 and the second frame member 32. Work implement 22 is supported such that its front periphery 40, rear periphery 41, left periphery 42 and right periphery 43 all extend beyond front edges 33, 34 of first and second frame member 31, 32, respectively. Specifically, first and second support receiving members 38 and 39, affixed to or an integral part of housing 23 and shorter in width than the rear portion of housing 23, are slidable across first and second support rods 26, 27, respectively. Furthermore, carrier 37 is disposed about threaded shaft 25 such that when threaded shaft 25 rotates about its longitudinal axis, carrier 37 moves along the longitudinal axis of threaded shaft 25. Carrier 37 is affixed to the rear of housing 23 and is also narrower than the width of the rear portion of housing 23.

Rotary attachment 10 also includes hydraulic motor 28 operatively connected to threaded shaft 25 for rotating threaded shaft 25 to thereby laterally shift work implement 22. First and second hydraulic lines 29 and 30 extending from hydraulic motor 28 may be connected to the hydraulic power source of loader 11. Thus, a means is provided to shift the position of the work implement between and relative to first and second frame members 31 and 32. In this embodiment, work implement 22 is shifted in a direction parallel to a line between first and second frame members 31 and 32.

Figure 3:
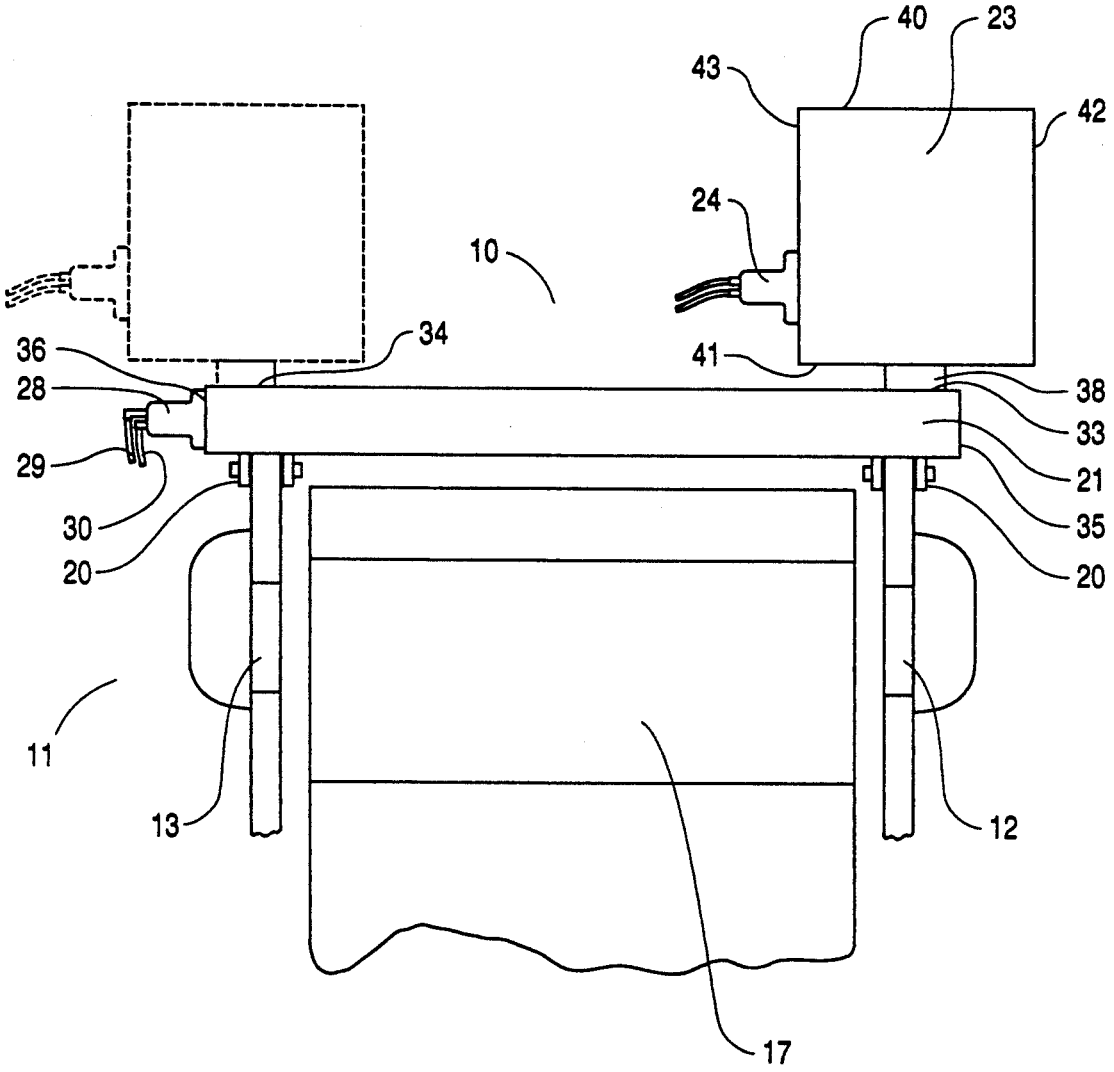
FIG. 3 shows a top view of the rotary attachment apparatus of the present invention mounted to a front end loader and fully laterally extended.

Referring now to FIG. 3, there is shown a top view of the rotary attachment apparatus of the present invention mounted to a front end loader. Two fully laterally shifted positions of rotary apparatus 10 are illustrated. In the first fully laterally shifted position illustrated by the solid lines, front periphery 40, rear periphery 41, left periphery 42 and right periphery 43 of rotary apparatus 10 all extend beyond front edges 33, 34 of first and second side frame members 31, 32 (see FIG. 2), respectively. Furthermore, left periphery 42 of rotary apparatus 10 extends laterally beyond side edge 35 of first frame member 31. In the second fully laterally shifted position illustrated by the broken lines, all peripheries 40–43 of rotary apparatus extend 10 beyond front edges 33, 34 of first and second side frame members 31,32 (see FIG. 2), respectively, and right periphery 43 extends laterally beyond side edge 36 of second frame member 32.

It will be appreciated by those of skill in the art that rotary attachment apparatus 10 is configured such that rotary work implement 22 extends beyond the side edges 35, 36 of first and second frame members 31, 32 when shifted such that carrier 37 and first and second support receiving members 38, 39 engage either first and second frame members 31, 32, respectively. This is particularly advantageous in allowing work implement 22 to be used to horizontally plane surfaces near a vertical wall or obstruction, such as a curb. Furthermore, loader 11 may remain on the surface to be planed. Loader 11 is not required to straddle the obstruction or to be positioned on a higher surface than the one to be planed.

It will also be appreciated that attachment apparatus 10 allows the operator to plane linearly when attachment apparatus 10 is laterally shifted between the two positions illustrated in FIG. 3. Thus, the planing of a road surface may begin and end along a straight line, perhaps perpendicular to the direction of the road thereby making a clean break for the area to be repaved.

Figure 4:
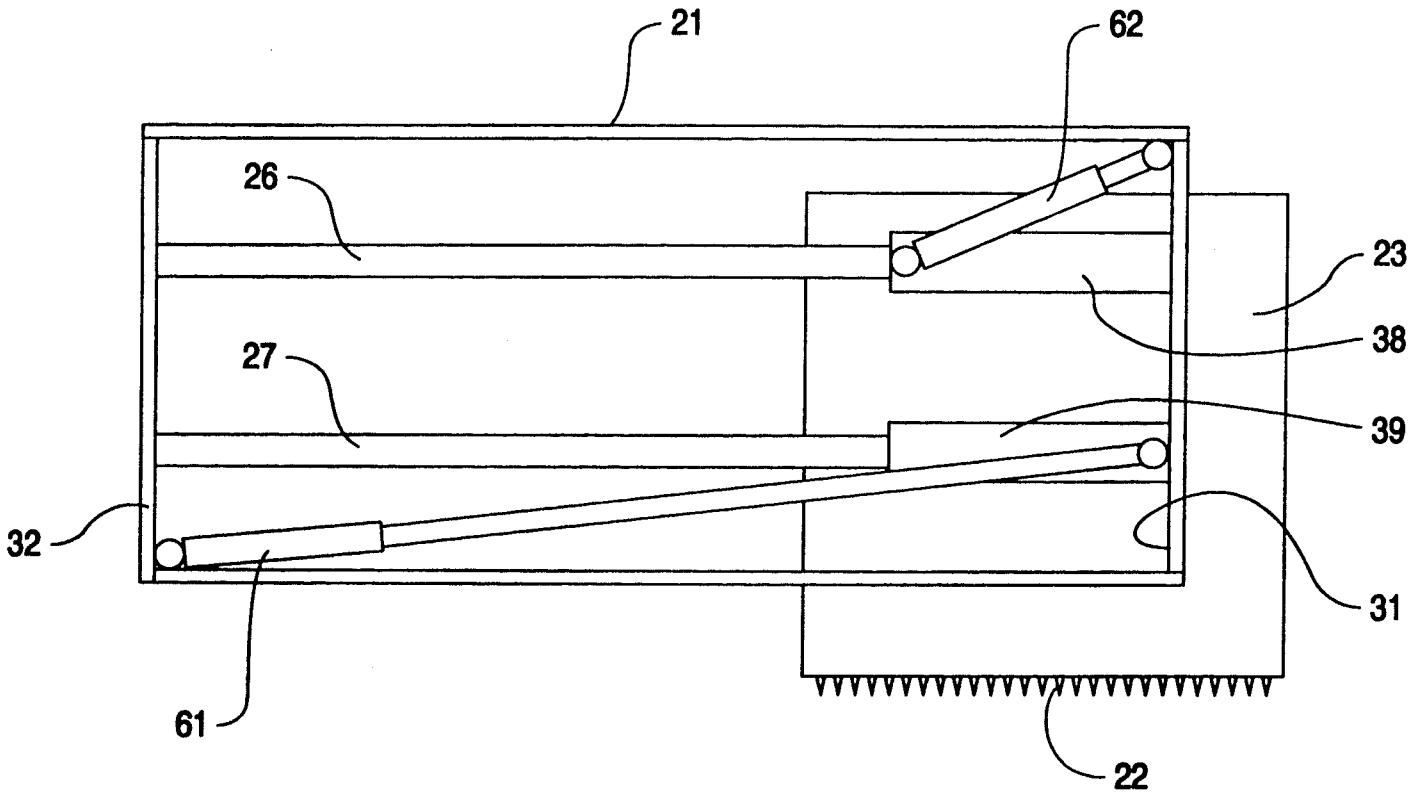
FIG. 4 shows a back view of another embodiment of the invention in which the attachment apparatus is laterally shifted by a pair of hydraulic cylinders.

It will be further appreciated that other supporting and shifting means may be used for the present invention. For example, as shown in FIG. 4, hydraulic cylinders 61, 62 are affixed between the frame of the apparatus and the carriers 38, 39 of the apparatus. One of cylinders may be extended while the other is simultaneously retracted to laterally shift the rotary apparatus. In this embodiment, support rods 26, 27 could be dispensed with if the hydraulic cylinders were appropriately sized and the movement thereof accurately controlled. Alternately, a single cylinder could be employed to move the apparatus in both directions.

Planer 10 may be adjusted vertically through the actuation of hydraulically powered lift arms 12 and 13. In particular, lift arms may be fully lowered so that front vehicle wheels 50, 51, are lifted from the ground and a portion of the weight of the vehicle is transferred to the attachment apparatus 10. This configuration improves the work of planer 22, as it reduces bouncing and vibration. It will further be appreciated that other means well known in the art may be provided to adjust the position of rotary work implement 22. For example, one or more hydraulic cylinders operatively connected to frame 21 and to work implement 22 may be used to tilt rotary implement 22 with respect to frame 21 thereby providing additional degrees of freedom for the positioning of rotary work implement 22. It will be further appreciated that the rotary attachment apparatus of the present invention may be an integral part of a self-propelled vehicle rather than necessarily being detachable and used in conjunction with a front end loader.

We claim:

1. A rotary apparatus detachably mountable to a self-propelled vehicle, the vehicle comprising a pair of opposing lift arms each outwardly adjacent to one of a pair of opposite sides of the vehicle, said lift arms being swingable up and down in unison and projecting forward to have front ends in front of a front end of the vehicle, and each of the lift arms comprising attachment means providing for removable mounting of the apparatus to the arms, the apparatus comprising:

a frame comprising a horizontal member and first and second vertical side frame members;

means located on the frame for attaching the apparatus to the lift arms;

the vertical side frame members each having a front edge and an inner side edge;

an axially rotatably work implement having front and rear peripheries and left side and right side peripheries;

a housing having an opened bottom partially enclosing the axially rotatable work implement;

means supporting the work implement from the first and second vertical side frame members such that the front, rear, left, and right peripheries may extend beyond the front edges of the vertical side frame members;

at least one ground engaging member extending from the apparatus for controlling the cutting depth of the work implement; and means for shifting the position of the work implement with respect to the frame members in a direction parallel to a line between the first and second vertical side frame members, such that one of the side peripheries of the work implement may extend beyond the side edge of the first vertical side frame member.

2. The rotary apparatus of claim 1 wherein the shifting means comprises at least one hydraulic cylinder.

3. The rotary apparatus of claim 1 wherein the shifting means comprises a carrier attached to the rotary apparatus and which operatively receives a rotatable threaded shaft, the threaded shaft being disposed between the first and second vertical side frame members.

4. The rotary apparatus of claim 3 wherein the shifting means comprises a hydraulic motor operatively connected to the threaded shaft.

5. The rotary apparatus of claim 4 wherein the hydraulic motor further comprises means for connection to a hydraulic pressure source of the vehicle.

6. The rotary apparatus of claim 1 wherein the rotatable work implement is hydraulically powered.

7. The rotary apparatus of claim 1 wherein the rotatable work implement comprises a cold planer.

8. The rotary apparatus of claim 1 wherein the left periphery is extendable beyond the first vertical side frame member, and the right periphery is extendable beyond the second vertical side frame member.

9. A rotary apparatus detachably mountable to a self-propelled vehicle, the vehicle comprising a pair of opposing lift arms each outwardly adjacent to one of a pair of opposite sides of the vehicle, said lift arms being swingable up and down in unison and projecting forward to have front ends in front of a front end of the vehicle, and each of the lift arms comprising attachment means providing for removable mounting of the apparatus to the arms, the apparatus comprising:

a frame comprising a horizontal member and first and second vertical side frame members;

means located on the frame for attaching the apparatus to the lift arms;

the vertical side frame members each having a front edge and an inner side edge;

an axially rotatable work implement having front and rear peripheries and left side and right side peripheries, the axis of rotation of the work implement having a constant angular relationship to a line between the first and second vertical frame members;

a housing having an opened bottom partially enclosing the axially rotatable work implement;

means supporting the work implement from the first and second vertical side frame members such that the front, rear, left, and right peripheries may extend beyond the front edges of the vertical side frame members;

at least one ground engaging member extending from the apparatus for controlling the cutting depth of the work implement; and means for shifting the position of the work implement between and relative to the first and second vertical side frame members, such that when all the peripheries of the work implement extend beyond the front edges of the vertical frame members, one of the peripheries of the work implement may extend beyond the side edge of the first vertical side frame member.

10. The rotary apparatus of claim 9 wherein the shifting means comprises at least one hydraulic cylinder.

11. The rotary apparatus of claim 9 wherein the shifting means comprises a carrier attached to the rotary apparatus and which operatively receives a rotatable threaded shaft, the threaded shaft being disposed between the first and second vertical side frame members.

12. The rotary apparatus of claim 11 wherein the shifting means comprises a hydraulic motor operatively connected to the threaded shaft.

13. The rotary apparatus of claim 12 wherein the hydraulic motor further comprises means for connection to a hydraulic pressure source of the vehicle.

14. The rotary apparatus of claim 9 wherein the rotatable work implement is hydraulically powered.

15. The rotary apparatus of claim 9 wherein the rotatable work implement comprises a cold planer.

16. The rotary apparatus of claim 9 wherein the left periphery is extendable beyond the first vertical side frame member, and the right periphery is extendable beyond the second vertical side frame member.

* * * * *